US011042107B2

(12) United States Patent
Kubo et al.

(10) Patent No.: US 11,042,107 B2
(45) Date of Patent: Jun. 22, 2021

(54) INTERMEDIATE TRANSFER MEDIUM AND IMAGE FORMING APPARATUS

(71) Applicants: Hidetaka Kubo, Kanagawa (JP); Masahiro Ohmori, Kanagawa (JP)

(72) Inventors: Hidetaka Kubo, Kanagawa (JP); Masahiro Ohmori, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 214 days.

(21) Appl. No.: 16/247,623

(22) Filed: Jan. 15, 2019

(65) Prior Publication Data

US 2019/0227463 A1 Jul. 25, 2019

(30) Foreign Application Priority Data

Jan. 24, 2018 (JP) ..... JP2018-009604
Nov. 9, 2018 (JP) ..... JP2018-211266

(51) Int. Cl.
*G03G 15/16* (2006.01)
*G03G 15/01* (2006.01)

(52) U.S. Cl.
CPC ..... *G03G 15/162* (2013.01); *G03G 15/0189* (2013.01); *G03G 15/161* (2013.01); *G03G 2215/1623* (2013.01)

(58) Field of Classification Search
CPC ..... G03G 15/161; G03G 15/162; G03G 15/1605; G03G 2215/1623
See application file for complete search history.

(56) References Cited

U.S. PATENT DOCUMENTS 5,745,831 A * 4/1998 Nakazawa ..... G03G 15/162 399/302
2011/0177238 A1 7/2011 Aoto et al.
2011/0293824 A1 12/2011 Aoto et al.
2012/0082488 A1 4/2012 Kubo et al.
2012/0201578 A1 8/2012 Mashiko et al.
2012/0262739 A1* 10/2012 Kubo ..... G03G 15/162 358/1.9
2013/0004212 A1 1/2013 Kubo et al.
2013/0129395 A1 5/2013 Kubo et al.
2014/0178103 A1 6/2014 Gohda et al.
(Continued)

FOREIGN PATENT DOCUMENTS

EP 0 716 355 A1 6/1996
EP 2 523 050 A1 11/2012
(Continued)

OTHER PUBLICATIONS

JP 2011118026 English machine translation, Kubo et al., Jun. 16, 2011 (Year: 2011).*
(Continued)

*Primary Examiner* — Thomas S Giampaolo, II
(74) *Attorney, Agent, or Firm* — Oblon, McClelland, Maier & Neustadt, L.L.P.

(57) ABSTRACT

An intermediate transfer medium onto which a toner image is transferred is provided. The intermediate transfer medium comprises a base layer and an elastic layer overlying the base layer. The elastic layer contains spherical fine particles to form an irregular surface, and the spherical fine particles have a volume resistivity of $1\times10^{-4}$ Ω·cm or more and less than $1\times10^{0}$ Ω·cm.

12 Claims, 6 Drawing Sheets

(56) References Cited

U.S. PATENT DOCUMENTS

| | | | | |
|---|---|---|---|---|
| 2014/0248069 | A1 | 9/2014 | Kubo et al. | |
| 2014/0248070 | A1 | 9/2014 | Kubo et al. | |
| 2014/0356042 | A1 | 12/2014 | Gondoh et al. | |
| 2015/0241817 | A1 | 8/2015 | Kubo et al. | |
| 2015/0261139 | A1 | 9/2015 | Kubo et al. | |
| 2016/0004192 | A1 | 1/2016 | Itoh et al. | |
| 2016/0274527 | A1 | 9/2016 | Gohda et al. | |
| 2017/0269513 | A1 | 9/2017 | Kubo et al. | |
| 2018/0267435 | A1* | 9/2018 | Kubo | G03G 15/0189 |

FOREIGN PATENT DOCUMENTS

| | | |
|---|---|---|
| JP | 9-230717 | 9/1997 |
| JP | 2000-217493 | 8/2000 |
| JP | 2002-162767 | 6/2002 |
| JP | 2004-354716 | 12/2004 |
| JP | 2007-328165 | 12/2007 |
| JP | 2009-075154 | 4/2009 |
| JP | 2011-118026 A | 6/2011 |
| JP | 2012-189724 | 10/2012 |
| JP | 2014-007058 | 1/2014 |
| JP | 2015-148660 | 8/2015 |
| JP | 2016-014707 | 1/2016 |
| JP | 2018-155953 | 10/2018 |

OTHER PUBLICATIONS

Extended European Search Report dated Jun. 4, 2019 in European Patent Application No. 18215968.1, 7 pages.

* cited by examiner

INTERMEDIATE TRANSFER MEDIUM AND IMAGE FORMING APPARATUS

CROSS-REFERENCE TO RELATED APPLICATIONS

This patent application is based on and claims priority pursuant to 35 U.S.C. § 119(a) to Japanese Patent Application Nos. 2018-009604 and 2018-211266, filed on Jan. 24, 2018 and Nov. 9, 2018, respectively, in the Japan Patent Office, the entire disclosure of each of which is hereby incorporated by reference herein.

BACKGROUND

Technical Field

The present disclosure relates to an intermediate transfer medium and an image forming apparatus.

Description of the Related Art

Conventionally, a seamless belt has been used as a member in various applications in an electrophotographic apparatus. Particularly in recent years, a full-color electrophotographic apparatus employs an intermediate transfer method in which developed images of four colors of yellow, magenta, cyan, and black are temporarily superimposed on an intermediate transfer medium and then collectively transferred onto a transfer medium such as paper.

The intermediate transfer method has been employed in a system using four developing devices (corresponding to the four colors) for one photoconductor, but has a drawback that the printing speed is slow. For this reason, in a high-speed printing system, a quadruple tandem system is employed in which four photoconductors (corresponding to the four colors) are arranged in tandem so that each color toner is continuously transferred onto paper. However, it is very difficult with this method to superimpose the four color images with high positional accuracy due to fluctuations of the condition of paper caused by the environment, resulting in an image out of color registration. In view of this situation, it is becoming mainstream to combine the quadruple tandem system with the intermediate transfer method.

In such circumstances, the intermediate transfer belt is required to meet demands for high-speed transfer and high positional accuracy which are more severe than conventional ones. In particular, with respect to positional accuracy, the intermediate transfer belt is required to suppress fluctuations caused by deformation (such as elongation) of the belt itself due to continuous use. In addition, the intermediate transfer belt is required to be flame retardant since it is laid over a wide area of the apparatus and a high voltage is applied thereto in transferring images. To meet such demands, the intermediate transfer belt is mainly comprised of a material such as polyimide resin and polyamideimide resin, each of which has high elastic modulus and high heat resistant.

However, the intermediate transfer belt made of polyimide resin has a high surface hardness because of its high strength and therefore applies a high pressure to the toner layer when transferring the toner image. As a result, a defective image with hollows may be generated in which toner is locally agglomerated and a part of the toner image is not transferred. In addition, such an intermediate transfer belt has poor contact followability with a contact member (such as a photoconductor and a paper sheet) at a transfer portion so that contact failure portions (voids) are partially generated in the transfer portion, causing transfer unevenness.

In recent years, images are often formed on various types of paper with full-color electrophotography. Not only normal smooth paper but also slippery smooth paper, such as coated paper, and rough-surface paper, such as recycled paper, embossed paper, Japanese paper, and craft paper, are increasingly used. The intermediate transfer belt should vary the followability according to the surface property of paper. Poor followability causes unevenness in density and color tone corresponding to the irregularities of the paper. In order to solve this problem, various intermediate transfer belts have been proposed in which a relatively flexible rubber elastic layer is laminated on a base layer.

For example, there has been a proposal to provide a protective layer on the elastic layer with a material having sufficiently high transfer performance. However, it is impossible for such a material to follow flexibility of the elastic layer, thus undesirably causing cracking and peeling. As another approach, there has been a proposal to improve transfer performance by adhering fine particles to the surface of the intermediate transfer belt.

SUMMARY

In accordance with some embodiments of the present invention, an intermediate transfer medium onto which a toner image is transferred is provided. The intermediate transfer medium comprises a base layer and an elastic layer overlying the base layer. The elastic layer contains spherical fine particles to form an irregular surface, and the spherical fine particles have a volume resistivity of $1\times10^{-4}$ or more and less than $1\times10^{0}$ Ω·cm.

In accordance with some embodiments of the present invention, an image forming apparatus is provided. The image forming apparatus includes: an image bearer configured to bear a latent image and a toner image; a developing device containing toner, configured to develop the latent image on the image bearer with the toner into the toner image; the above-described intermediate transfer medium onto which the toner image is primarily transferred; and a transfer device configured to secondarily transfer the toner image on the intermediate transfer medium onto a recording medium.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
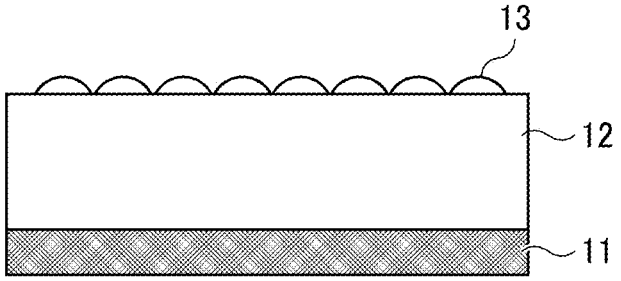
FIG. 1 is a schematic cross-sectional view of an intermediate transfer belt suitably used as the intermediate transfer medium according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

Within the context of the present disclosure, if a first layer is stated to be "overlaid" on, or "overlying" a second layer, the first layer may be in direct contact with a portion or all of the second layer, or there may be one or more intervening layers between the first and second layer, with the second layer being closer to the substrate than the first layer.

In accordance with some embodiments of the present invention, an intermediate transfer medium is provided that has excellent toner transfer property onto a sheet of paper having surface irregularities and that does not cause abnormal electrical discharge even after the sheet is passed thereon for a long term in a low-temperature low-humidity environment.

The intermediate transfer medium according to an embodiment of the present invention may be in the form of a belt or a drum, but is not limited thereto and can be suitably selected. Preferably, the intermediate transfer medium is an intermediate transfer belt particularly in the form of or a seamless belt (maybe also called as an endless belt). As a specific example of the intermediate transfer medium, an intermediate transfer belt is described below.

The intermediate transfer medium according to an embodiment of the present invention is preferably used in the form of a seamless belt and suitably equipped in an image forming apparatus, such as a copier and a printer, particularly for full color image formation. Specifically, the seamless belt is suitably equipped as an intermediate transfer belt in an electrophotographic apparatus employing an intermediate transfer method (i.e., an apparatus in which multiple color-toner images are sequentially formed on an image bearer (such as a photoconductor drum) and primarily transferred onto an intermediate transfer belt in a sequential manner to form a primary transfer image and the primary transfer image is secondarily transferred onto a recording medium in a collective manner).

FIG. 1 is a schematic cross-sectional view of an intermediate transfer belt suitably used as the intermediate transfer medium according to an embodiment of the present invention. An elastic layer 12 having flexibility is laminated on a rigid base layer 11 that is relatively bendable. Spherical fine particles 13 are independently embedded in the outermost surface of the elastic layer 12 and aligned in the direction of the surface of the elastic layer, thus uniformly forming an irregular surface. In a state in which the spherical fine particles 13 are independently present, there is almost no overlap of the spherical fine particles 13 in the thickness direction of the layer and almost no complete embedment of the spherical fine particles 13 in the elastic layer 12.

Base Layer

The base layer 11 is described in detail below. The base layer 11 may be comprised of a resin containing an electrical resistance adjusting material that is a filler (or an additive) for adjusting electrical resistance.

Preferred examples of such a resin include, for flame retardancy, fluorine-based resins such as polyvinylidene fluoride (PVDF) and ethylene tetrafluoroethylene (ETFE), polyimide resins, and polyamideimide resins. For mechanical strength (high elasticity) and heat resistance, polyimide resins and polyamideimide resins are particularly preferable.

Examples of the electrical resistance adjusting material include, but are not limited to, metal oxides, carbon blacks, ion conducting agents, and conductive polymer materials. Specific examples of the metal oxides include, but are not limited to, zinc oxide, tin oxide, titanium oxide, zirconium oxide, aluminum oxide, and silicon oxide. These metal oxides may have a surface treatment to improve dispersibility. Specific examples of the carbon blacks include, but are not limited to, Ketjen black, furnace black, acetylene black, thermal black, and gas black. Specific examples of the ion conducting agents include, but are not limited to, tetraalkylammonium salts, trialkylbenzylammonium salts, alkylsulfonates, alkylbenzenesulfonates, alkylsulfates, glycerin fatty acid esters, sorbitan fatty acid esters, polyoxyethylene alkylamines, polyoxyethylene aliphatic alcohol esters, alkyl betaine, lithium perchlorate, and combinations thereof.

The electrical resistance adjusting material according to an embodiment of the present invention is not limited to the above exemplary compounds.

A coating liquid used for manufacturing the seamless belt according to an embodiment of the present invention contains at least a resin component and further optionally contains additives such as a dispersing auxiliary agent, a reinforcing material, a lubricant, a thermal conduction material, and an antioxidant, if necessary.

When the seamless belt is used as the intermediate transfer belt, the coating liquid contains carbon black in an amount such that the intermediate transfer belt has a surface resistivity and a volume resistivity of $1\times10^{8}$ to $1\times10^{13}\Omega/\square$ and $1\times10^{8}$ to $1\times10^{11}$ $\Omega\cdot$cm, respectively. In addition, the addition amount of the carbon black is determined such that the resulting layer does not become brittle and fragile in terms of mechanical strength. That is, to be used as the intermediate transfer belt, the seamless belt is preferably manufactured using a coating liquid in which the resin component (e.g., polyimide resin precursor, polyamideimide resin precursor) and the electrical resistance adjusting material are blended at an appropriate ratio to achieve a good balance between electric characteristics (i.e., surface resistivity and volume resistivity) and mechanical strength.

The thickness of the base layer is not particularly limited and may be appropriately selected according to the purpose, but is preferably from 30 to 150 μm, more preferably from 40 to 120 μm, and particularly preferably from 50 to 80 μm. When the thickness of the base layer is less than 30 μm, the belt easily splits due to cracks. When the thickness exceeds 150 μm, the belt may break when being bent. The thickness of the base layer within the above-described particularly preferable range is advantageous for durability. It is preferable to eliminate unevenness in thickness of the base layer as much as possible to improve running stability.

The method for adjusting the thickness of the base layer is not particularly limited and may be appropriately selected according to the purpose. For example, the thickness may be measured with a contact-type or eddy-current-type film thickness meter or from a cross-sectional image of the base layer obtained by a scanning electron microscope (SEM).

In a case in which the electrical resistance adjusting material is carbon black, the content thereof in the coating liquid is from 10% to 25% by weight, preferably from 15% to 20% by weight, of the total solid content in the coating liquid. In a case in which the electrical resistance adjusting material is a metal oxide, the content thereof in the coating liquid is from 1% to 50% by weight, preferably from 10% to 30% by weight, of the total solid content in the coating liquid. When the content of the electrical resistance adjusting material is below the above-described ranges, it becomes more difficult to achieve uniformity of the resistivity value and the resistivity value greatly varies with respect to an arbitrary electric potential. When the content is above the above-described respective ranges, mechanical strength of the intermediate transfer belt is lowered, which is not preferable for practical use.

The polyimide and polyamideimide resins described above are available as general-purpose products from manufacturers such as DU PONT-TORAY CO., LTD., Ube Industries, Ltd., New Japan Chemical Co., Ltd., JSR Corporation, UNITIKA LTD., I.S.T. Corporation, Hitachi Chemical Company, Ltd., Toyobo Co., Ltd., and ARAKAWA CHEMICAL INDUSTRIES, LTD.

Elastic Layer

Next, the elastic layer 12 overlying the base layer 11 is described in detail below.

The elastic layer 12 may be comprised a general-purpose resin, elastomer, or rubber. Preferably, the elastic layer 12 is comprised of a material having sufficient flexibility (elasticity) to fully exhibit the effect of the present invention, such as an elastomer material or a rubber material.

Examples of the elastomer material include, but are not limited to, thermoplastic elastomers such as polyester-based, polyamide-based, polyether-based, polyurethane-based, polyolefin-based, polystyrene-based, polyacrylic-based, polydiene-based, silicone-modified-polycarbonate-based, and fluoro-copolymer-based elastomers. Examples of the elastomer material further include thermosetting elastomers such as polyurethane-based, silicone-modified-epoxy-based, and silicone-modified-acrylic-based elastomers.

Examples of the rubber material include, but are not limited to, isoprene rubber, styrene rubber, butadiene rubber, nitrile rubber, ethylene propylene rubber, butyl rubber, silicone rubber, chloroprene rubber, acrylic rubber, chlorosulfonated polyethylene, fluororubber, urethane rubber, and hydrin rubber.

From among the various elastomers and rubbers described above, those which can achieve a desired performance are appropriately selected. In view of ozone resistance, flexibility, adhesion to spherical fine particles, flame retardancy, and environmental stability, acrylic rubber is most preferable in the present embodiment. Details of the acrylic rubber is described below.

The acrylic rubber used for the elastic layer of the present embodiment may be that available from the market and is not particularly limited. Among various types of acrylic rubbers having cross-links (formed with epoxy group, active chlorine group, or carboxyl group), those having carboxyl-group-based cross-links are preferable for excellent rubber properties (in particular, compression set) and processability thereof.

As a cross-linking agent used for the acrylic rubber having carboxyl-group-based cross-links, an amine compound is preferable and a polyvalent amine compound is most preferable.

Examples of the amine compound include, but are not limited to, aliphatic polyvalent amine cross-linking agents and aromatic polyvalent amine cross-linking agents. Specific examples of the aliphatic polyvalent amine cross-linking agents include, but are not limited to, hexamethylenediamine, hexamethylenediamine carbamate, and N,N'-dicinnamylidene-1,6-hexanediamine.

Examples of the aromatic polyvalent amine cross-linking agents include, but are not limited to, 4,4'-methylenedianiline, m-phenylenediamine, 4,4'-diaminodiphenyl ether, 3,4'-diaminodiphenyl ether, 4,4'-(m-phenylenediisopropylidene) dianiline, 4,4'-(p-phenylenediisopropylidene)dianiline, 2,2'-bis[4-(4-aminophenoxy)phenyl]propane, 4,4'-diaminobenzanilide, 4,4'-bis(4-aminophenoxy)biphenyl, m-xylylenediamine, p-xylylenediamine, 1,3,5-benzenetriamine, and 1,3,5-benzenetriaminomethyl.

The amount of the cross-linking agent to be blended with 100 parts by weight of the acrylic rubber is preferably from 0.05 to 20 parts by weight, more preferably from 0.1 to 5 parts by weight.

When the blending amount of the cross-linking agent is too small, cross-linking is not sufficiently performed, so that it becomes difficult to maintain the shape of the cross-linked product.

When the blending amount is too large, the cross-linked product becomes so hard that elasticity as cross-linked rubber is impaired.

In preparing the acrylic-rubber elastic layer of the present embodiment, a cross-linking accelerator may be further blended in combination with the cross-linking agent. The cross-linking accelerator is also not particularly limited as long as the cross-linking accelerator can be used in combination with the polyvalent amine cross-linking agent. Examples of such a cross-linking accelerator include, but are not limited to, guanidine compounds, imidazole compounds, quaternary onium salts, polyvalent tertiary amine compounds, tertiary phosphine compounds, and alkali metal salts of weak acids. Specific examples of the guanidine compounds include, but are not limited to, 1,3-diphenylguanidine and 1,3-diorthotolylguanidine. Specific examples of the imidazole compounds include, but are not limited to, 2-methylimidazole and 2-phenylimidazole. Specific examples of the quaternary onium salts include, but are not limited to, tetra n-butyl ammonium bromide and octadecyl tri-n-butyl ammonium bromide.

Specific examples of the polyvalent tertiary amine compounds include, but are not limited to, triethylenediamine and 1,8-diaza-bicyclo[5.4.0]undecene-7 (DBU).

Specific examples of the tertiary phosphine compounds include, but are not limited to, triphenylphosphine and tri-p-tolylphosphine.

Specific examples of the alkali metal salts of weak acids include, but are not limited to, inorganic weak acid salts (such as phosphate and carbonate) and organic weak acid salts (such as stearate and laurate) of sodium or potassium.

The amount of the cross-linking accelerator used for 100 parts by weight of the acrylic rubber is preferably from 0.1 to 20 parts by weight, more preferably from 0.3 to 10 parts by weight.

When the amount of the cross-linking accelerator is too large, the cross-linking rate may become too fast at the time of cross-linking, blooming of the cross-linking accelerator to the surface of the cross-linked product may occur, or the cross-linked product may become too hard. When the amount of the cross-linking accelerator is too small, tensile strength of the cross-linked product may be remarkably lowered, or elongation change or tensile strength change after thermal loading may be too large.

In preparing the acrylic rubber, an appropriate mixing method can be employed, such as roll mixing, Banbury mixing, screw mixing, and solution mixing. There are no particular limitation on the order of blending of components. Preferably, components that are hardly react or decompose by heat are sufficiently mixed first, and components that are easily react or decompose by heat (such as the cross-linking agent) are thereafter mixed in a short time at a temperature at which no reaction or decomposition occurs.

The acrylic rubber can be made into a cross-linked product by heating. The heating temperature is preferably from 130° C. to 220° C., more preferably from 140° C. to 200° C. The cross-linking time is preferably from 30 seconds to 5 hours.

The heating method may be appropriately selected from known methods for cross-linking rubber, such as press heating, steam heating, oven heating, and hot air heating. Also, post-cross-linking may be performed after the cross-linking in order to ensure cross-linking inside the cross-linked product. The post-cross-linking is preferably performed for 1 to 48 hours, but the time varies depending on the heating method, cross-linking temperature, and shape. The heating method and heating temperature in the post-cross-linking may be appropriately selected.

As to flexibility of the rubber elastic layer, it is preferable that a micro rubber hardness of the elastic layer is from 30 to 80 at 25° C., 50% RH. The micro rubber hardness can be measured by a commercially-available micro rubber hardness meter such as Micro Durometer MD-1 manufactured by Kobunshi Keiki Co., Ltd.

The film thickness of the elastic layer is preferably from 200 to 500 μm, more preferably from 300 to 400 μm. When the film thickness is less than 200 μm, the image quality on paper having surface irregularities becomes insufficient. When the film thickness is greater than 500 μm, the film layer becomes heavier, becomes easy to bend, or warps larger, so that the running performance becomes unstable. It is desirable that the variation in film thickness is within 5% of the total film thickness. The film thickness can be measured from a cross-section of the layer obtained by a scanning electron microscope (SEM).

Spherical Fine Particles

Next, spherical fine particles disposed on the surface of the elastic layer are described in detail below. The material of the spherical fine particles is not particularly limited as long as the volume resistivity of the particles is $1\times10^{-4}$ Ω·cm or more and less than $1\times10^{0}$ Ω·cm. Examples of such particles include, but are not limited to, particles made of only metals and organic or inorganic core particles coated with metals by means of plating or the like. In particular, it is preferable that the spherical fine particles are those in which the surfaces of core particles are coated with a metal.

The resistivity of the particles can be measured by instruments MCP-PD 51 and LORESTA GP both available from Mitsubishi Chemical Analytech Co., Ltd. Here, the spherical fine particles refer to particles having a true spherical shape with an average particle diameter of 100 μm or less. The average particle diameter of the particles is not particularly limited as long as the particles can be packed such that toner does not enter the interstices between the particles. Preferably, the average particle diameter of 100 randomly-selected particles is from 0.5 to 5 μm, more preferably from 1 to 2 μm.

Shape of Spherical Fine Particles

Figure 2A:
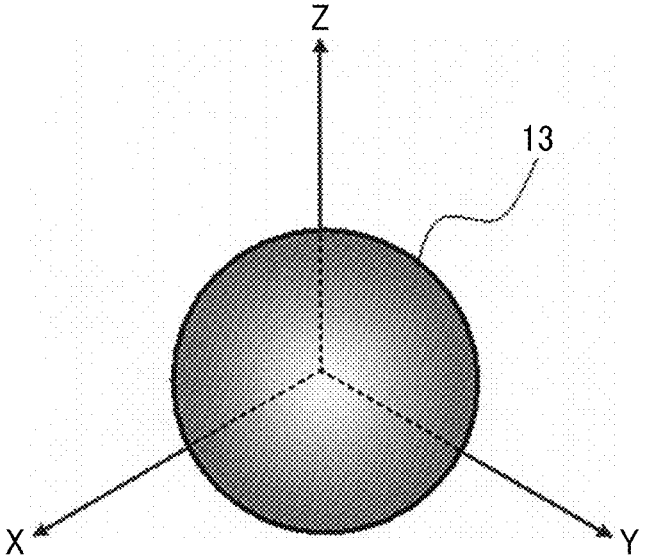
FIGS. 2A to 2C are diagrams for explaining how to measure the shape of spherical fine particles according to an embodiment of the present invention.
Figure 2B:
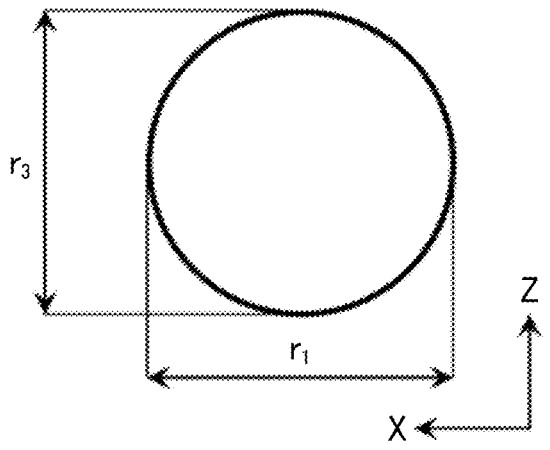
Figure 2C:
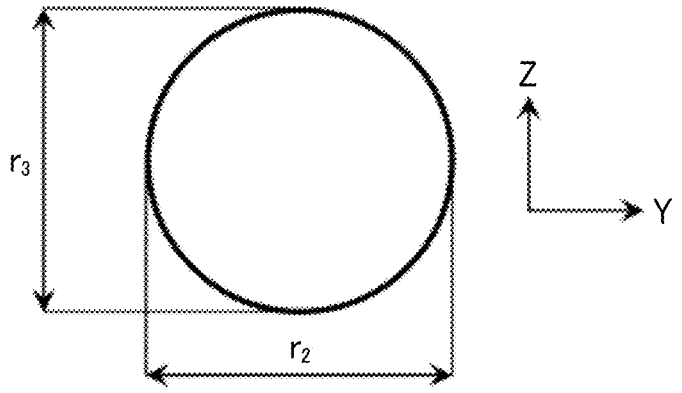

FIGS. 2A to 2C are diagrams for explaining how to measure the shape of the spherical fine particles.

First, the particles are uniformly dispersed on and adhered to a smooth measurement surface, and 100 randomly-selected particles are observed with a color laser microscope (VK-8500 available from Keyence Corporation) at an arbitrary magnification (for example, 1,000 times). Each of the 100 particles is subjected to a measurement of a major axis $r_1$ (μm), a minor axis $r_2$ (μm), and a thickness $r_3$ (μm), as illustrated in FIGS. 2A to 2C, and an arithmetic mean value of each of $r_1$ to $r_3$ is determined. When the ratio ($r_2/r_1$) of the arithmetic mean value of the minor axis $r_2$ to that of the major axis $r_1$ is 0.9 to 1.0 and the ratio ($r_3/r_2$) of the arithmetic mean value of the thickness $r_3$ to that of the minor axis $r_2$ is from 0.9 to 1.0, the particles are determined to be spherical.

In particular, particles obtained by coating organic or inorganic core particles having high resistivity with a metal are preferable for adjusting the resistivity of the particles. Such core particles may be comprised of, for example, acrylic resins such as polymethyl methacrylate and polymethyl acrylate; polyolefin resins such as polyethylene, polypropylene, polyisobutylene, and polybutadiene; polystyrene resins; melamine resins; or silica. Examples of the metal to coat the surface of the core particles include, but are not limited to, metals such as gold, silver, copper, platinum, zinc, iron, palladium, nickel, tin, chromium, titanium, aluminum, cobalt, germanium, and cadmium; and metal compounds such as ITO (indium tin oxide) and solder. The metal layer be either a single layer or a laminated layer comprising plurality of layers. Among the above-described metals, nickel, silver, and gold are preferable because they are easy to be plated, and nickel is particularly preferable for its inexpensiveness. The above-described coating materials may be either a simple substance of a metal or an alloy of a plurality of the above-described materials.

The method of coating the surface of the particles with a metal may be selected from known methods, such as electroless plating, substitution plating, electroplating, and sputtering. Among these methods, electroless plating is particularly preferable because it is easy to control the thickness of the metal layer. The thickness of the metal layer is not particularly limited, but is preferably in the range of from 0.005 to 0.5 μm, more preferably in the range of from 0.01 to 0.3 μm. When the thickness of the metal layer is less than 0.005 μm, the resistivity of the particles becomes higher than $1\times10^{0}$ Ω·cm, and when the thickness exceeds 1.0 μm, the resistivity of the particles becomes lower than $1\times10^{-4}$ Ω·cm, each of which is undesirable. The spherical fine particles may be commercial products available from Mitsubishi Materials Corporation or Nippon Chemical Industrial Co., Ltd.

Measurement of Volume Resistivity of Spherical Fine Particles

The volume resistivity of the spherical fine particles can be measured as follows. First, 1 g of the particles is placed in a pressurized container having a diameter of 15 mm and applied with a load of 20 KN, in an environment of 23° C., 50% RH. The volume resistivity is calculated from the value read at 90 V. The volume resistivity of the spherical fine particles is $1\times10^{-4}$ Ω·cm or more and less than $1\times10^{0}$ Ω·cm, more preferably from $1\times10^{-3}$ to $1\times10^{-1}$ Ω·cm. When the volume resistivity is $1\times10^{0}$ Ω·cm or higher, the effect of suppressing abnormal discharge is not fully exhibited. Conversely, when the volume resistivity is lower than $1\times10^{-4}$ Ω·cm, the transfer rate of the toner decreases greatly since no transfer electric field is generated. The volume resistivity of the particles can be adjusted to be within the above-described preferable range by changing the thickness of the metal layer. The thinner the coating layer, the higher the volume resistivity. The thicker the coating layer, the lower the volume resistivity.

Surface Condition of Belt

Next, the surface condition of the intermediate transfer belt in the present embodiment is described in detail below.

Figure 3A:
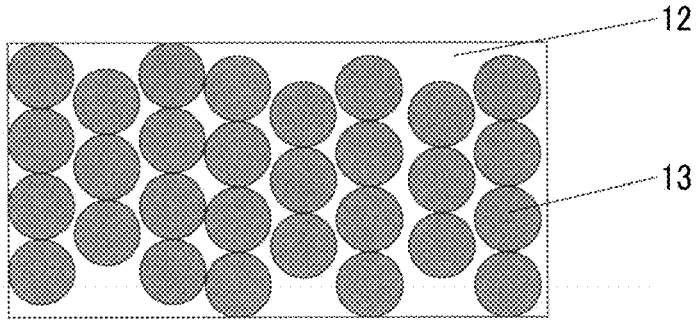
FIG. 3A is a magnified plan view of the surface of the intermediate transfer belt observed from directly above.
Figure 3B:
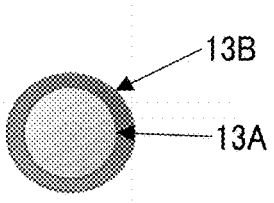
FIG. 3B is a schematic view of one spherical fine particle.
Figure 3C:
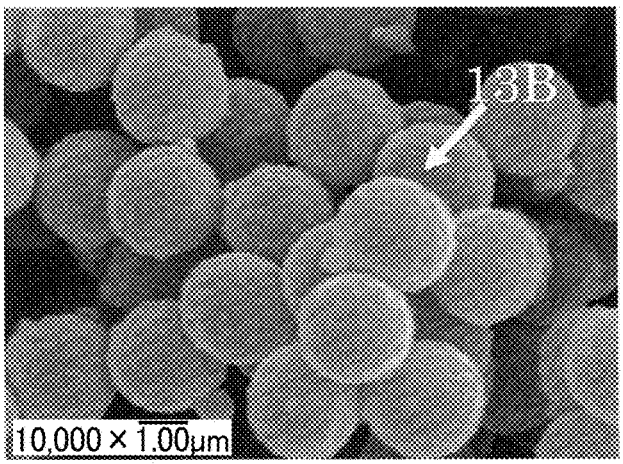
FIG. 3C is an image of the spherical fine particles observed with an electron microscope.

FIG. 3A is a magnified plan view of the surface of the intermediate transfer belt observed from directly above. As illustrated, the spherical fine particles having a uniform particle size are arranged in an orderly and independent manner. Almost no overlap between the particles is observed. It is preferable that the particles have a uniform cross-sectional diameter on a plane of the surface of the elastic layer. Specifically, it is preferable that the cross-sectional particle diameter distribution has a width ranging from—(average particle diameter×0.5) μm to+(average particle diameter×0.5) μm on the surface of the elastic layer. FIG. 3B is a schematic view of one spherical fine particle. The spherical fine particle contains a core particle 13A and a metal 13B coating the surface of the core particle. FIG. 3C is an image of the spherical fine particles observed with an electron microscope.

It is preferable to form the surface with such particles having a uniform particle diameter as much as possible. It is also possible to form the surface with particles having a certain particle diameter which are selected to have the above-described particle diameter distribution, without using the particles having a uniform particle diameter.

The ratio of the surface area occupied by the particles is preferably 60% or more. When the ratio is less than 60%, the elastic layer is exposed too much to allow toner to come into contact with the rubber, resulting in poor transferability.

In the present embodiment, the spherical fine particles are partially embedded in the elastic layer. The average embedment rate is preferably more than 50% and less than 100%, more preferably from 50% to 99%, much more preferably from 51% to 90%, and particularly preferably from 60% to 80%. When the average embedment rate is 50% or less, desorption of the particles is likely to occur during long-term use in an image forming apparatus, resulting in poor durability. When the average embedment rate is 100%, the effect on particle transferability is reduced, which is not preferable. When the average embedment rate is in the preferable range of from 50% to 99%, durability is excellent. When the average embedment rate is in the more preferable range of from 51% to 90%, cleanability is excellent. When the average embedment rate is in the particularly preferable range of from 60% to 80%, toner transferability is excellent.

The average embedment rate is the rate of embedment of the diameter of the spherical fine particle in the elastic layer in the depth direction. Here, the average embedment rate does not require that all the particles be embedded at an embedment rate of more than 50% and less than 100% and just requires that the average value of the embedment rates for the particles observed in a certain visual field be more than 50% and less than 100%. When the average embedment rate is 50%, a particle which is almost completely embedded in the elastic layer is hardly observed in a cross-section observed by an electron microscope. Such particles which are almost completely embedded in the elastic layer account for 5% by number or less of all the particles.

The average embedment rate can be measured by observing a cross-section of an arbitrary portion on the surface of the elastic layer with a scanning electron microscope (SEM, product name: VE-7800, manufactured by Keyence Corporation) at a magnification of 5,000 times to measure the rate of embedment of the diameter of each of 10 randomly-selected spherical fine particles in the thickness direction of the elastic layer and averaging the measured values.

Method for Manufacturing Intermediate Transfer Belt

Next, a method for manufacturing the intermediate transfer belt according to an embodiment of the present invention is described in detail below. First, a method for preparing the base layer 11 illustrated in FIG. 1 is described.

As an example, the base layer can be prepared using a coating liquid containing at least a resin component, that is, a coating liquid containing the polyimide resin precursor or the polyamideimide resin precursor.

The coating liquid containing at least a resin component (e.g., the polyimide resin precursor or the polyamideimide resin precursor) is uniformly applied to and casted on the outer surface of a cylinder (e.g., cylindrical metallic mold) by a liquid supplying device (e.g., a nozzle or a dispenser) while the cylinder is rotated slowly, thus forming a coating film. The rotation speed is thereafter increased to a predetermined speed and maintained at the predetermined speed for a desired time. The temperature is gradually increased while rotating the cylinder so that the solvent in the coating film is evaporated at a temperature of about 80° C. to 150° C. In this process, it is preferable to efficiently circulate and remove the vapor of the atmosphere (e.g., volatilized solvent). At the time when a self-supportive film is formed, the film together with the mold is put in a heating furnace (firing furnace) capable of high-temperature treatment. The temperature is raised stepwise and a high-temperature heat treatment (firing) is finally performed at about 250° C. to 450° C. to make the polyimide resin precursor or the polyamideimide resin precursor into the polyimide resin or the polyamideimide resin. After the resulting base layer is sufficiently cooled, the elastic layer 12 is subsequently laminated thereon as illustrated in FIG. 1.

The elastic layer 12 can be prepared by coating the base layer with a rubber coating material in which a rubber is dissolved in an organic solvent, then drying the solvent, and vulcanizing the rubber. The coating method may be selected from known coating methods such as spiral coating, die coating, and roll coating. To improve transferability of irregularities, it is preferable that the elastic layer is thick. To form a thick film, die coating and spiral coating are preferred. To easily vary the thickness of the elastic layer in the width direction, spiral coating is preferred. Details of spiral coating are described below. First, a rubber coating material is continuously supplied from a round-shape or wide-width nozzle being moved in the axial direction of the base layer, while the base layer is rotated in the circumferential direction, so that the base layer is coated with the coating material in a spiral manner. The coating material spirally applied to the base layer is leveled and dried as the rotation speed and drying temperature are maintained. The rubber is further vulcanized (cross-linked) at a certain vulcanization temperature.

Method for Forming Surface of Belt

The vulcanized elastic layer is sufficiently cooled and subsequently the spherical fine particles 13 are applied onto the elastic layer 12 to obtain a desired seamless belt (intermediate transfer belt).

Figure 4:
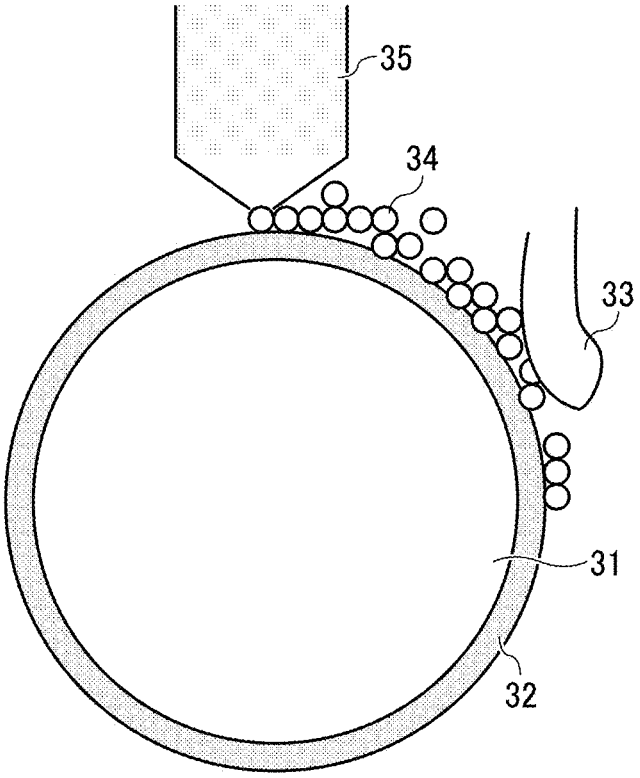
FIG. 4 is a schematic view illustrating a method for forming a layer of the spherical fine particles.

FIG. 4 is a schematic view illustrating a method for forming a layer of the spherical fine particles. A powder supply device 35 and a pressing member 33 are disposed as illustrated in FIG. 4. The powder supply device 35 uniformly dusts a surface of a belt 32 with spherical fine particles 34 while a metal mold drum 31 around which the belt 32 is wound is rotated. The spherical fine particles 34 on the surface of the belt 32 are pressed by the pressing member 33 at a constant pressure. The pressing member 33 embeds the spherical fine particles 34 in the elastic layer of the belt 32 while removing surplus particles. Since monodisperse spherical particles are used in the present embodiment, it is possible to form a homogeneous single particle layer by a simple process of leveling with the pressing member. The average embedment rate is adjusted by adjusting the length of the pressing time of the pressing member.

The average embedment rate may also be adjusted by another method. For example, the adjustment is easily conducted by adjusting the pressing force of the pressing member 33. For example, it is relatively easy to achieve the average embedment rate of more than 50% and less than 100% by adjusting the pressing force to 1 to 1,000 mN/cm when the viscosity of the coating liquid is from 100 to 100,000 mPa·s, although it depends on the viscosity, solid content, solvent content, particle material, etc., of the coating liquid.

After the spherical fine particles are uniformly arranged on the surface, the belt is heated at a predetermined temperature for a predetermined time to be hardened, while being rotated, thereby forming an elastic layer in which the particles are embedded. After being sufficiently cooled, the elastic layer along with the base layer is detached from the mold to obtain a desired seamless belt (intermediate transfer belt).

Method for Measuring Average Embedment Rate of Spherical Fine Particles in Intermediate Transfer Belt A method for measuring the average embedment rate of the spherical fine particles in the intermediate transfer belt is as follows.

The average embedment rate can be measured by observing a cross-section of an arbitrary portion on the surface of the elastic layer with a scanning electron microscope (SEM, product name: VE-7800, manufactured by Keyence Corporation) at a magnification of 5,000 times to measure the rate of embedment (see the following formula) of the diameter of each of 10 randomly-selected spherical fine particles in the depth direction of the elastic layer and averaging the measured values.

Rate of Embedment=(Length of Embedment of Diameter in Depth Direction/Diameter of Particle)×100

The resistivity of the intermediate transfer belt thus prepared is adjusted by varying the amounts of carbon black and ion conducting agents. It is to be noted that the resistivity easily changes depending on the size and occupied area ratio of the particles. The resistivity can be measured with a commercially-available measuring instrument such as HIRESTA available from Mitsubishi Chemical Analytech Co., Ltd. (formerly Dia Instruments Co., Ltd.).

When the volume resistivity of the particles on the surface of the elastic layer is $1\times10^{-4}$ Ω·cm or more and less than $1\times10^{0}$ Ω·cm, in a low-temperature low-humidity environment, although the resistivity of the belt becomes relatively higher than that in a normal-temperature normal-humidity environment due to environmental dependency, transferability is maintained. The reason for this is presumed that abnormal discharge is suppressed due to the low resistivity of the particles on the outermost surface (toner contacting surface) of the belt.

In the present embodiment, the volume resistivity of the intermediate transfer belt is preferably from $1\times10^{8}$ to $1\times10^{11}$ Ω·cm, more preferably from $1\times10^{9}$ to $3\times10^{10}$ Ω·cm, and particularly preferably from $2\times10^{9}$ to $2\times10^{10}$ Ω·cm. When the volume resistivity is in the preferable range, dust particle resistance is excellent. When the volume resistivity is in the more preferable range, a residual image is less likely to appear. When the volume resistivity is in the particularly preferable range, toner transferability is excellent.

In the present embodiment, the surface resistivity of the intermediate transfer belt is preferably from $1\times10^{8}$ to $1\times10^{13}$Ω/□, more preferably from $1\times10^{9}$ to $1\times10^{11}$Ω/□, and particularly preferably from $3\times10^{9}$ to $3\times10^{10}$Ω/□. When the surface resistivity is in the preferable range, dust particle resistance is excellent. When the surface resistivity is in the more preferable range, a residual image does not appear. When the surface resistivity is in the particularly preferable range, toner transferability is excellent.

Image Forming Apparatus

An image forming apparatus according to an embodiment of the present invention includes: an image bearer configured to bear a latent image and a toner image; a developing device containing toner, configured to develop the latent image on the image bearer with the toner into the toner image; an intermediate transfer medium onto which the toner image is primarily transferred; and a transfer device configured to secondarily transfer the toner image on the intermediate transfer medium onto a recording medium. The image forming apparatus may further include other devices such as a charge remover, a cleaner, a recycler, and a controller.

It is preferable that the image forming apparatus is a full-color image forming apparatus in which multiple pairs of a latent image bearer and a developing device containing a different color toner are arranged in series.

An electrophotographic apparatus ("image forming apparatus") according to an embodiment of the present invention equipped with a seamless belt is described in detail below with reference to the drawings. The drawing are for the purpose of illustration only and are not intended to be limiting.

Figure 5:
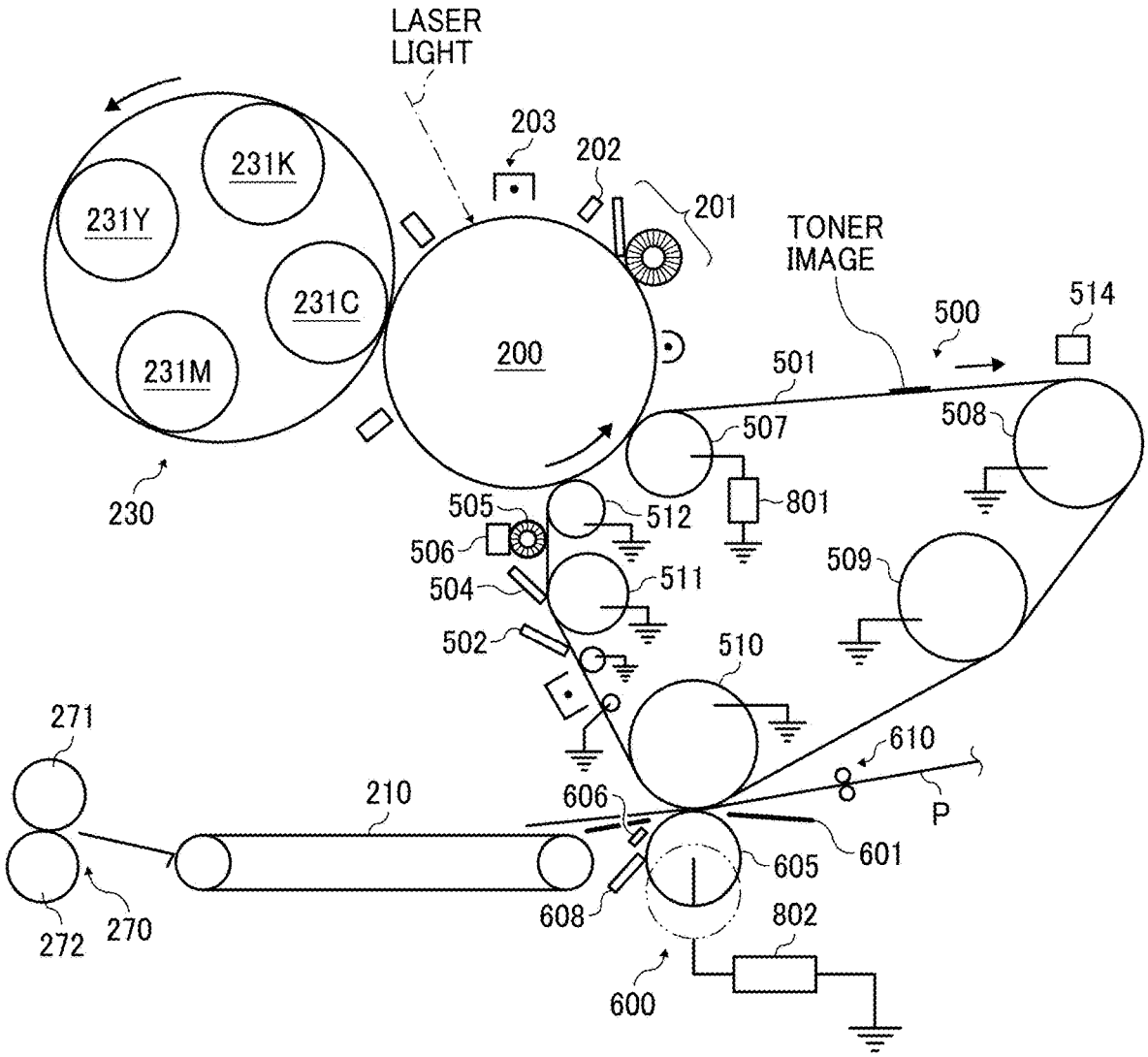
FIG. 5 is a schematic view of a main part of an image forming apparatus according to an embodiment of the present invention equipped a seamless belt.

FIG. 5 is a schematic view of a main part of an image forming apparatus according to an embodiment of the present invention equipped with a seamless belt.

An intermediate transfer unit 500 includes an intermediate transfer belt 501, serving as an intermediate transfer medium, stretched around a plurality of rollers. Around the intermediate transfer belt 501, a secondary transfer bias roller 605 serving as a secondary transfer charger of a secondary transfer unit 600, a belt cleaning blade 504 serving as an intermediate transfer medium cleaner, and a lubricant application brush 505 serving as a lubricant applicator are disposed facing the intermediate transfer belt 501.

A position detection mark is provided on the outer circumferential surface or inner circumferential surface of the intermediate transfer belt 501. On the outer circumferential surface of the intermediate transfer belt 501, the position detection mark should be provided avoiding the area where the belt cleaning blade 504 passes, which may make an arrangement more difficult. In such a case, the position detection mark may be provided on the inner circumferential surface of the intermediate transfer belt 501. An optical sensor 514 serving as a mark detection sensor is disposed facing the intermediate transfer belt 501 at a position between a primary transfer bias roller 507 and a belt driving roller 508 on which the intermediate transfer belt 501 is stretched.

The intermediate transfer belt 501 is stretched around the primary transfer bias roller serving as a primary transfer charger, the belt driving roller 508, a belt tension roller 509, a secondary transfer opposing roller 510, a cleaning opposing roller 511, and a feedback current detecting roller 512. Each of the rollers is made of a conductive material, and each of the rollers other than the primary transfer bias roller 507 is grounded. The primary transfer bias roller 507 is applied with a transfer bias controlled to a current or voltage of a predetermined magnitude according to the number of overlapping toner images by a primary transfer power source 801 controlled at a constant current or a constant voltage.

The intermediate transfer belt 501 is driven in the direction indicated by arrow in FIG. 5 by the belt driving roller 508 driven to rotate in the direction indicated by arrow in FIG. 5 by a driving motor.

The intermediate transfer belt 501 may be made of a semiconductor or an insulator and may have a monolayer or multilayer structure. The intermediate transfer belt 501 is a seamless belt that provides excellent durability and image quality. The intermediate transfer belt is larger than the maximum size of sheet to make it possible to superimpose toner images formed on a photoconductor drum 200 thereon.

The secondary transfer bias roller 605 serving as a secondary transfer device is brought into contact with and separated from a portion of the outer circumferential surface of the intermediate transfer belt 501 which is stretched around the secondary transfer opposing roller 510 by a contact-separation mechanism. The secondary transfer bias roller 605 is disposed such that a transfer sheet P serving as a recording medium can be sandwiched between the secondary transfer bias roller 605 and a portion of the intermediate transfer belt 501 which is stretched around the secondary transfer opposing roller 510. The secondary transfer bias roller 605 is applied with a transfer bias of a predetermined current by a secondary transfer power source 802 controlled at a constant current.

A registration roller 610 feeds the transfer sheet P to between the secondary transfer bias roller 605 and the intermediate transfer belt 501 that is stretched around the secondary transfer opposing roller 510 at a predetermined timing. A cleaning blade 608 serving as a cleaner is in contact with the secondary transfer bias roller 605. The cleaning blade 608 removes deposits adhering to the surface of the secondary transfer bias roller 605 to clean the secondary transfer bias roller 605.

As an image forming cycle is started in this image forming apparatus, the photoconductor drum 200 is rotated counterclockwise as indicated by arrow in FIG. 5 by a driving motor, and a black (Bk) toner image, a cyan (C) toner image, a magenta (M) toner image, and a yellow (Y) toner image are formed on the photoconductor drum 200. The intermediate transfer belt 501 is rotated clockwise as indicated by arrow in FIG. 5 by the belt driving roller 508. As the intermediate transfer belt 501 rotates, the Bk toner image, the C toner image, the M toner image, and the Y toner image are primarily transferred by a transfer bias that is a voltage applied to the primary transfer bias roller 507. The toner images are then superimposed on the intermediate transfer belt 501 in the order of Bk, C, M and Y.

As an example, the Bk toner image can be formed by the following process.

Referring to FIG. 5, a charger 203 uniformly charges the surface of the photoconductor drum 200 to a predetermined negative potential by a corona discharge. The photoconductor drum 200 is then exposed to laser light emitted from an optical writing unit based on a Bk color image signal (i.e., raster exposure) at a timing determined based on a belt mark detection signal. At the time of the raster exposure, in the exposed portion of the uniformly-charged surface of the photoconductor drum 200, an amount of charge proportional to the amount of exposure light disappears and a Bk electrostatic latent image is formed. As a negatively-charged Bk toner on a developing roller of a Bk developing device 231K is brought into contact with the Bk electrostatic latent image, the toner does not adhere to a portion of the photoconductor drum 200 where the electric charge remains but adheres to the exposed portion thereof where the electric charge is absent. Thus, a Bk toner image having a similar shape to the Bk electrostatic latent image is formed.

The Bk toner image thus formed on the photoconductor drum 200 is primarily transferred onto the outer circumferential surface of the intermediate transfer belt 501 that is driven to rotate at a constant speed in contact with the photoconductor drum 200. A small amount of untransferred residual toner remaining on the surface of the photoconductor drum 200 after the primary transfer is removed by a photoconductor cleaner 201 in preparation for reuse of the photoconductor drum 200. On the other hand, the photoconductor drum 200 proceeds to a C image forming process that follows the Bk image forming process. In the C image forming process, a color scanner starts reading of C image data at a predetermined timing and the C image data is written on the surface of the photoconductor drum 200 with laser light to form a C electrostatic latent image.

After the trailing end portion of the Bk electrostatic latent image passes a developing position and before the leading end portion of the C electrostatic latent image reaches the developing position, a revolver developing unit 230 rotates to allocate a C developing device 231C to the developing position. Thus, the C electrostatic latent image is developed with a C toner. The development of the C electrostatic latent image area is thereafter continued. At the time when the trailing end portion of the C electrostatic latent image passes the developing position, the revolver developing unit 230 rotates again to allocate an M developing device 231M to the developing position. The rotation is completed before the leading end portion of the next Y electrostatic latent image reaches the developing position. Detailed descriptions for M and Y image forming processes are omitted since the operations in color image data reading, electrostatic latent image formation, and developing in the M and Y image forming processes are the same as those in the Bk and C image forming processes described above.

The toner images of Bk, C, M, and Y sequentially formed on the photoconductor drum 200 are primarily transferred onto the same surface of the intermediate transfer belt 501 in a sequential manner with position alignment. As a result, a composite toner image is formed on the intermediate transfer belt 501, in which at most four color toners are superimposed. On the other hand, at the time when the image forming operation is started, the transfer sheet P is fed from a sheet feeder, such as a transfer sheet cassette or a manual sheet feeding tray, and stands by at the nip of the registration roller 610.

The registration roller 610 is driven to convey the transfer sheet P along a transfer sheet guide plate 601 in synchronization with an entry of the leading end of the composite toner image on the intermediate transfer belt 501 into a secondary transfer portion where a nip is formed between the intermediate transfer belt 501 stretched around the secondary transfer opposing roller 510 and the secondary transfer bias roller 605, so that the leading end of the transfer sheet P coincides with the leading end of the toner image, thus achieving a registration of the transfer sheet P and the toner image.

As the transfer sheet P passes through the secondary transfer portion, the composite toner image in which four color toners are superimposed on the intermediate transfer belt 501 are collectively transferred onto the transfer sheet P (i.e., secondary transfer) by a transfer bias that is a voltage applied to the secondary transfer bias roller 605 by the secondary transfer power source 802. The transfer sheet P is conveyed along the transfer sheet guide plate 601 and subjected to charge removal by passing through a portion facing a transfer sheet charge removing device 606 having a charge removing needle, disposed downstream from the secondary transfer portion. The transfer sheet P is further conveyed to a fixing device 270 by a belt conveying device 210. The composite toner image is fused and fixed on the transfer sheet P at a nip portion formed between fixing rollers 271 and 272 in the fixing device 270. The transfer sheet P is ejected to the outside of the main body of the apparatus by an ejection roller and stacked face-up on a copy tray. The fixing device 270 may be equipped with a belt component as necessary.

On the other hand, after the transfer of the composite toner image, the surface of the photoconductor drum 200 is cleaned by the photoconductor cleaner 201 and uniformly electrically neutralized by a charge removing lamp 202. Residual toner remaining on the outer circumferential surface of the intermediate transfer belt 501 after the composite toner image is secondarily transferred therefrom onto the transfer sheet P is cleaned by the belt cleaning blade 504. The belt cleaning blade 504 is configured to contact and separate from the outer circumferential surface of the intermediate transfer belt 501 at a predetermined timing by a cleaning member contact-separation mechanism.

On the upstream side of the belt cleaning blade 504 in the direction of movement of the intermediate transfer belt 501, a toner sealing member 502 that contacts and separates from the outer circumferential surface of the intermediate transfer belt 501 is disposed. The toner sealing member 502 receives toner falling from the belt cleaning blade 504 during removal of residual toner and prevents the falling toner from scattering onto the conveyance path of the transfer sheet P. The toner sealing member 502 is brought into contact with and separated from the outer peripheral surface of the intermediate transfer belt 501 together with the belt cleaning blade 504 by the cleaning member contact-separation mechanism.

A lubricant 506 scraped off by the lubricant application brush 505 is applied to the outer circumferential surface of the intermediate transfer belt 501 from which the residual toner has been removed. The lubricant 506 is made of a solid material such as zinc stearate and is disposed in contact with the lubricant application brush 505. Residual charge remaining on the outer circumferential surface of the intermediate transfer belt 501 is removed by a charge removing bias applied by a belt charge removing brush in contact with the outer circumferential surface of the intermediate transfer belt 501. The lubricant application brush 505 and the belt charge removing brush are brought into contact with and separated from the outer circumferential surface of the intermediate transfer belt 501 at a predetermined timing by respective contact-separation mechanisms.

At the time of repeat copying, the color scanner and the photoconductor drum 200 operate at a predetermined timing to proceed to image formation of the first color (BK) in the second copy, following image formation of the fourth color (Y) in the first copy. The Bk toner image in the second copy is then primarily transferred onto the outer circumferential surface of the intermediate transfer belt 501 at an area which is cleaned by the belt cleaning blade 504, after the composite toner image in the first copy, in which four color toners are superimposed, is collectively transferred onto the transfer sheet. The image forming operation then proceeds in the same manner as in the first copy. The above description relates to a four-color (full-color) copy mode. In the case of a three-color copy mode or a two-color copy mode, the same operation as described above is performed for the designated color and number of times. In the case of a single color copy mode, one of the developing devices in the revolver developing unit 230 which corresponds to the predetermined color is put into developing operation while the belt cleaning blade 504 is kept in contact with the intermediate transfer belt 501, until copying on the predetermined number of sheets is completed.

The above-described embodiment provides an image forming apparatus (copier) including only one photoconductor drum. Another embodiment of the present invention provides an image forming apparatus including a plurality of photoconductor drums arranged side by side along one intermediate transfer belt comprised of a seamless belt, as illustrated in FIG. 6.

Figure 6:
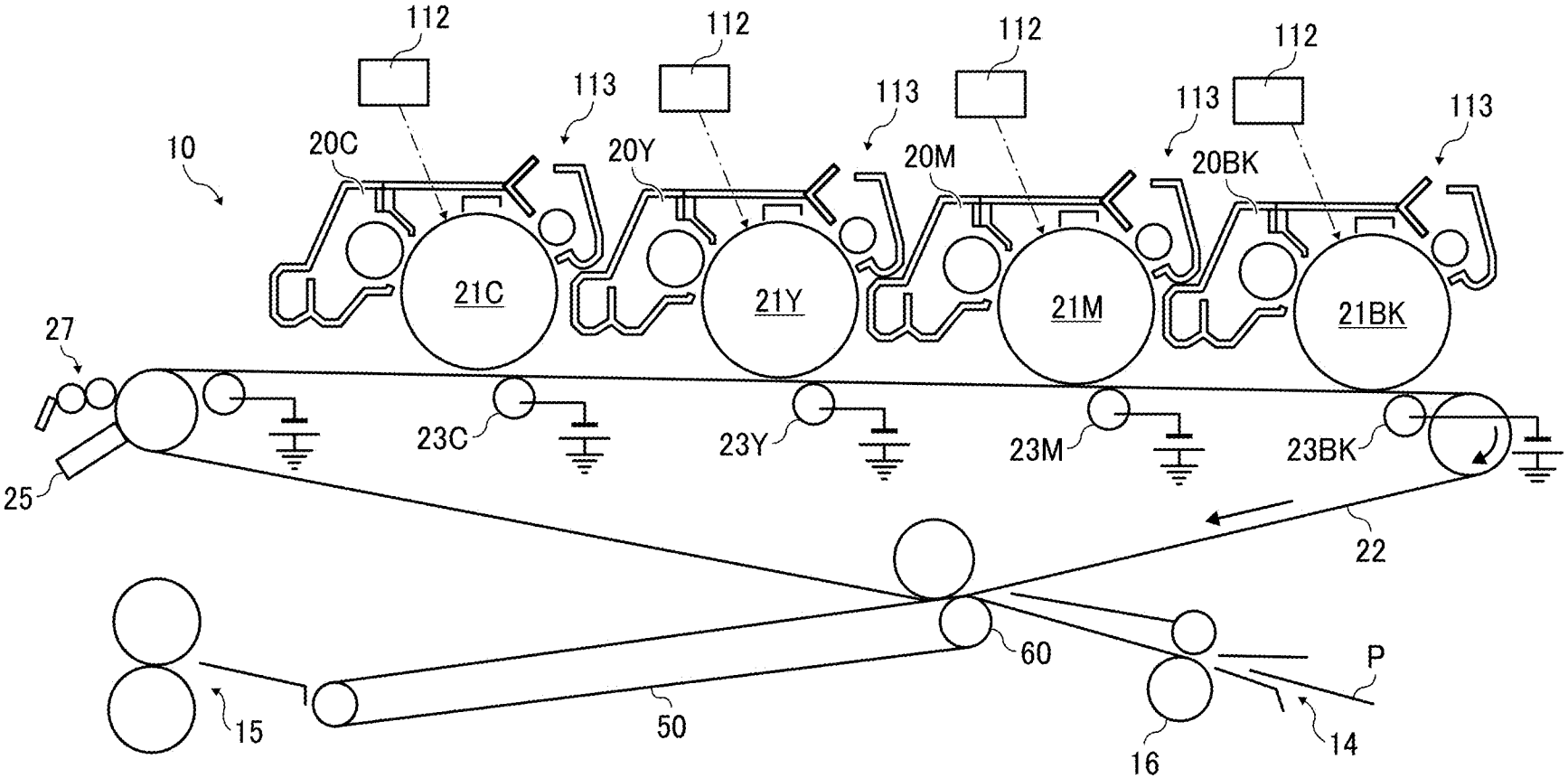
FIG. 6 is a schematic view of an image forming apparatus according to an embodiment of the present invention, that is a four-drum type digital color printer having four photoconductors for forming toner images of four different colors.

FIG. 6 is a schematic view of a four-drum type digital color printer having four photoconductor drums (hereinafter "photoconductors") 21BK, 21M, 21Y, and 21C for forming toner images of four different colors of black, magenta, yellow, and cyan, respectively.

Referring to FIG. 6, a printer main body 10 includes an image writing unit 112, an image forming unit 113, and a sheet feeder 14, for forming a color image by electrophotography. An image processor performs an image processing to convert an image signal into color signals of black (BK), magenta (M), yellow (Y), and cyan (C) used for image formation and transmits the color signals to the image writing unit 112. The image writing unit 112 may be a laser scanning optical system comprised of a laser light source, a deflector such as a rotating polygon mirror, a scanning imaging optical system, and a mirror group.

The image writing unit 112 has four optical paths for writing images on the respective photoconductors (image bearers) 21BK, 21M, 21Y, and 21C provided in the image forming unit 113, based on the respective color signals.

The image forming unit 113 includes the photoconductors 21BK, 21M, 21Y, and 21C serving as image bearers for black (BK), magenta (M), yellow (Y), and cyan (C), respectively. Each of the photoconductors may be an organic photoconductor (OPC). Around each of the photoconductors 21BK, 21M, 21Y, and 21C, a charger, an exposure portion to expose the photoconductor to laser light emitted from the image writing unit 112, a developing device 20BK, 20M, 20Y, or 20C (corresponding to black, magenta, yellow, and cyan, respectively), a primary transfer bias roller 23BK, 23M, 23Y, or 23C serving as a primary transferrer, a cleaner, and a photoconductor charge removing device are disposed. The developing devices 20BK, 20M, 20Y, and 20C employ a two-component magnetic brush developing method. An intermediate transfer belt 22 is interposed between the group of photoconductors 21BK, 21M, 21Y, and 21C and the group of primary transfer bias rollers 23BK, 23M, 23Y, and 23C. Toner images formed on the photoconductors are sequentially superimposed and transferred onto the intermediate transfer belt 22.

On the other hand, a transfer sheet P is fed from the sheet feeder 14 and carried on a transfer conveyance belt 50 via a registration roller 16. At a position where the intermediate transfer belt 22 and the transfer conveyance belt 50 are in contact with each other, the toner images transferred onto the intermediate transfer belt 22 are secondarily and collectively transferred by a secondary transfer bias roller 60 serving as a secondary transferrer. Thus, a full-color image is formed on the transfer sheet P. The transfer sheet P on which the full-color image is formed is conveyed to a fixing device 15 by the transfer conveyance belt 50. The fixing device 15 fixes the full-color image on the transfer sheet P, and the transfer sheet P is ejected to the outside of the printer body.

Residual toner remaining on the intermediate transfer belt 22 without being transferred in the secondary transfer is removed from the intermediate transfer belt 22 by a belt cleaner 25. On the downstream side of the belt cleaner 25, a lubricant applicator 27 is disposed. The lubricant applicator 27 is comprised of a solid lubricant and a conductive brush that rubs against the intermediate transfer belt 22 to apply the solid lubricant thereto. The conductive brush is in constant contact with the intermediate transfer belt 22 to apply the solid lubricant to the intermediate transfer belt 22. The solid lubricant enhances cleanability of the intermediate transfer belt 22, prevents the occurrence of filming, and improves durability.

EXAMPLES

Further understanding can be obtained by reference to certain specific examples which are provided herein for the purpose of illustration only and are not intended to be limiting.

Resistivity of Spherical Fine Particles and Belt

Resistivity of the spherical fine particles was measured by instruments MCP-PD 51 and LORESTA GP both available from Mitsubishi Chemical Analytech Co., Ltd. Specifically, 1 g of the particles was placed in a pressurized container having a diameter of 15 mm and applied with a load of 20 KN, in an environment of 23° C., 50% RH. The resistivity was calculated from the value read after application of a bias at 90 V for 30 seconds.

In addition, surface resistivity and volume resistivity of the belt were determined from the values measured by HIRESTA UP after application of a bias of 500 V for 10 seconds in an environment of 23° C., 50% RH.

Example 1

A coating liquid for base layer was prepared as follows. A base layer of a seamless belt was prepared using this coating liquid.

Preparation of Coating Liquid for Base Layer

First, a liquid dispersion of a carbon black (SPECIAL BLACK 4 manufactured by Evonik Industries AG) dispersed in N-methyl-2-pyrrolidone by a bead mill was blended in a polyimide varnish (U-VARNISH A manufactured by Ube Industries, Ltd.) containing a polyimide resin precursor as a main component, such that the carbon black content was 17% by weight of the polyamic acid solid content. The mixture was thoroughly stirred and mixed to prepare a coating liquid A.

Preparation of Belt having Polyimide Base Layer

Next, a metallic cylindrical support, serving as a mold, having an outer diameter of 500 mm, a length of 400 mm, and an outer surface roughened by blasting was attached to a roll coater. Subsequently, the coating liquid A for base layer was poured into a pan and drawn up by a coating roller rotating at a rotation speed of 40 mm/sec. The thickness of the coating liquid drawn up on the coating roller was controlled by adjusting the gap between a regulating roller and the coating roller to 0.6 mm.

The cylindrical support was then brought close to the coating roller while being controlled to rotate at a rotation speed of 35 mm/sec to make the gap between the cylindrical support and the coating roller be 0.4 mm, so that the coating liquid carried on the coating roller was uniformly transferred onto the cylindrical support. The cylindrical support was then put in a hot air circulating dryer while keeping rotating, gradually heated to 110° C. and kept for 30 minutes, further heated to 200° C. and kept for 30 minutes, and stopped rotating.

The cylindrical support was then introduced into a heating furnace (firing furnace) capable of high temperature treatment and heated to 320° C. stepwise to be fired for 60 minutes. After sufficient cooling, a belt A having a polyimide base layer having a film thickness of 60 μm was prepared.

Preparation of Elastic Layer on Polyimide Base Layer

The following components were blended at ratios described below and kneaded to prepare a rubber composition.

Acrylic rubber (NIPOL AR 12 manufactured by Zeon Corporation): 100 parts by weight Stearic acid (STEARIC ACID CAMELLIA manufactured by NOF CORPORATION): 1 part by weight Red phosphorus (RINKA FE 140F manufactured by RIN KAGAKU KOGYO Co., Ltd.): 10 parts by weight Aluminum hydroxide (HIGILITE H42M manufactured by Showa Denko K.K.): 40 parts by weight Cross-linking agent (DIAK No.1, hexamethylenediamine carbamate, manufactured by Du Pont Dow Elastomer Japan): 0.6 parts by weight Cross-linking accelerator (VULCOFAC ACT 55, comprised of 70% of a salt of 1,8-diazabicyclo(5,4,0)undecene-7 and diprotic acid and 30% of amorphous silica, manufactured by Safic-Alcan): 0.6 parts by weight The rubber composition was dissolved in an organic solvent (MIBK: methyl isobutyl ketone) to prepare a rubber solution having a solid content of 35% by weight. The cylindrical support on which the polyimide base layer was formed was rotated to be spirally coated with the above-prepared rubber solution that was continuously discharged from a nozzle moving in the direction of axis of the cylindrical support. The amount of coating was determined such that the film thickness became 400 μm. The cylindrical support coated with the rubber solution was put in a hot air circulating dryer while kept rotating and heated to 90° C. at a heating rate of 4° C./min and maintained for 30 minutes.

Preparation of Spherical Fine Particles

Spherical fine particles A were prepared by coating polystyrene spherical particles having an average particle diameter of 2.0 μm with nickel by electroless plating. The spherical fine particles A were cut with a cryomicrotome to obtain a cross-section and the cross-section was observed with a transmission electron microscope (TEM). As a result, the thickness of the metal layer was 27 nm and the volume resistivity of the particle was $9.2\times10^{-2}$ Ω·cm.

Next, the surface of the heated rubber composition was evenly dusted with the spherical fine particles A by the method illustrated in FIG. 4, and the pressing member 33 that is a polyurethane rubber blade was pressed against the elastic layer (rubber layer) at a pressing force of 100 mN/cm. Subsequently, the cylindrical support was put in the hot air circulating dryer again and heated to 170° C. at a heating rate of 4° C./min and maintained for 60 minutes. Thus, an intermediate transfer belt A was prepared.

Example 2

The procedure in Example 1 was repeated except for replacing the spherical fine particles A with other spherical fine particles B in which the thickness of the nickel layer was changed, thus obtaining an intermediate transfer belt B. In this example, the thickness of the metal layer was 70 nm and the volume resistivity of the particles was $2.3\times10^{-3}$ Ω·cm.

Example 3

The procedure in Example 1 was repeated except for replacing the spherical fine particles A with other spherical fine particles C in which the thickness of the nickel layer was changed, thus obtaining an intermediate transfer belt C. In this example, the thickness of the metal layer was 80 nm and the volume resistivity of the particles was $8.3\times10^{-4}$ Ω·cm.

Example 4

The procedure in Example 1 was repeated except for replacing the polystyrene spherical particles (i.e. core particles) having an average particle diameter of 2.0 μm with other polystyrene spherical particles having an average particle diameter of 6.0 μm, thus obtaining an intermediate transfer belt D. In this example, the thickness of the metal layer was 22 nm and the volume resistivity of the particles was $7.6\times10^{-1}$ Ω·cm.

Example 5

The procedure in Example 1 was repeated except for replacing the polystyrene spherical particles (i.e. core particles) having an average particle diameter of 2.0 μm with other polystyrene spherical particles having an average particle diameter of 5.0 μm, thus obtaining an intermediate transfer belt E. In this example, the thickness of the metal layer was 22 nm and the volume resistivity of the particles was $9.6\times10^{-1}$ Ω·cm.

Example 6

The procedure in Example 1 was repeated except for replacing the spherical fine particles A with other spherical fine particles D in which the thickness of the nickel layer was changed, thus obtaining an intermediate transfer belt F. In this example, the thickness of the metal layer was 90 nm and the volume resistivity of the particles was $1.1\times10^{-4}$ Ω·cm.

Comparative Example 1

The procedure in Example 1 was repeated except for replacing the spherical fine particles A with spherical silver particles having an average particle diameter of 2.0 μm, thus obtaining an intermediate transfer belt G. The volume resistivity of the particles was $1.3\times10^{-5}$ Ω·cm.

Comparative Example 2

The procedure in Comparative Example 1 was repeated except for replacing the spherical silver particles with spherical zinc oxides particles (PAZET GK-40 manufactured by HakusuiTech Co., Ltd.) having an average particle diameter of 3.5 μm, thus obtaining an intermediate transfer belt H. The volume resistivity of the particles was 21 Ω·cm.

The average embedment rate (%) of the spherical fine particles used in the above Examples and Comparative Examples was measured as follows.

Measurement of Average Embedment Rate

The average embedment rate was measured by observing a cross-section of an arbitrary portion on the surface of the elastic layer with a scanning electron microscope (SEM, product name: VE-7800, manufactured by Keyence Corporation) at a magnification of 5,000 times to measure the rate of embedment (%) of the diameter of each of 10 randomly-selected spherical fine particles in the depth direction of the elastic layer and averaging the measured values.

Each of the intermediate transfer belts A to H prepared in the above-described Examples and Comparative Examples was mounted on the image forming apparatus illustrated in FIG. 6 to output a blue solid image on 50,000 sheets of a paper LEATHAC 66 215 kg (i.e., embossed paper, having irregularities on its surface) in an environment of 10° C., 15% RH. The output images were visually observed to confirm whether abnormal discharge occurred or not. In the judgment, A indicates no abnormal discharge, B indicates partial abnormal discharge, C indicates abnormal discharge on the entire surface, and "–" indicates almost white paper onto which no image has been transferred.

The transfer rate was also measured at the same time. In the judgment of the transfer rate, A+ indicates 90% or more, A indicates from 80% to 90%, B indicates from 70% to 80%, and C indicates less than 70%.

In addition, as an evaluation of cleanability of the belt, the surface of the belt was observed with a laser microscope after the above-described test to confirm whether or not toner remained in the interstices of the particles to cause cleaning failure. The results are presented in Table 1.

TABLE 1

| | Belt | Volume Resistivity of Particles (Ω · cm) | Surface Resistivity of Belt (Ω/□) | Volume Resistivity of Belt (Ω · cm) | Average Embedment Rate of Particles (%) | Abnormal Discharge | Transfer Rate | Cleanability |
|---|---|---|---|---|---|---|---|---|
| Example 1 | A | $9.2 \times 10^{-2}$ | $1.4 \times 10^{11}$ | $8.4 \times 10^{9}$ | 67 | A | A+ | A (No problem) |
| Example 2 | B | $2.3 \times 10^{-3}$ | $1.3 \times 10^{11}$ | $8.3 \times 10^{9}$ | 66 | A | A | A (No problem) |
| Example 3 | C | $8.3 \times 10^{-4}$ | $1.5 \times 10^{11}$ | $8.4 \times 10^{9}$ | 67 | A | B | A (No problem) |
| Example 4 | D | $7.6 \times 10^{-1}$ | $1.5 \times 10^{11}$ | $8.5 \times 10^{9}$ | 52 | B | A+ | B (Residual toner partially in interstices between particles) |
| Example 5 | E | $9.6 \times 10^{-1}$ | $1.5 \times 10^{11}$ | $8.5 \times 10^{9}$ | 53 | B | A+ | A (No problem) |
| Example 6 | F | $1.1 \times 10^{-4}$ | $1.3 \times 10^{11}$ | $8.5 \times 10^{9}$ | 67 | B | A+ | A (No problem) |
| Comparative Example 1 | G | $1.3 \times 10^{-5}$ | $1.1 \times 10^{11}$ | $8.2 \times 10^{9}$ | 65 | — | C | A (No problem) |
| Comparative Example 2 | H | $2.1 \times 10^{1}$ | $1.4 \times 10^{11}$ | $8.4 \times 10^{9}$ | 58 | C | A+ | A (No problem) |

It is clear from the above results that, firstly, even when the volume resistivity of the spherical fine particles varies from the power-of-minus-four order to the power-of-one order, the measured value of resistivity of the transfer belt itself does not vary. However, there is a big difference in the degree of abnormal discharge in the low-temperature low-humidity environment. In the belt F using the spherical fine particle having the highest resistivity, abnormal discharge occurred on the entire surface. By contrast, in the belt E using the spherical fine particles having the lowest resistivity, toner has not been transferred at all. This indicates that even when there is no difference in resistivity of the belt, it is not preferable that the volume resistivity of the particles is too high or too low. In the belt D using spherical fine particles having a particle diameter of 6 μm, it is confirmed that residual toner was remaining in the interstices between the particles, resulting in a slightly inferior cleanability.

Accordingly, some embodiments of the present invention provide: an intermediate transfer belt that has excellent toner transfer property onto a sheet of paper having surface irregularities and that does not cause abnormal electrical discharge even after the sheet is passed thereon for a long term in a low-temperature low-humidity environment; and an image forming apparatus using the intermediate transfer belt, suitable for forming full-color images.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. An intermediate transfer medium onto which a toner image is transferred, comprising:

a base layer; and an elastic layer overlying the base layer, the elastic layer containing spherical fine particles deposited on a surface of the elastic laver to form an irregular surface, the spherical fine particles having a volume resistivity of $1\times10^{-4}$ or more and less than $1\times10^{0}$ Ω·cm, wherein the spherical particles are partially embedded in the surface of the elastic layer.

2. The intermediate transfer medium of claim 1, wherein the spherical fine particles each comprise:

a core particle; and a metal covering a surface of the core particle.

3. The intermediate transfer medium of claim 2, wherein the metal comprises nickel.

4. The intermediate transfer medium of claim 2, wherein a thickness of the metal covering the surface of the core particle is from 0.01 to 0.3 μm.

5. The intermediate transfer medium of claim 1, wherein the spherical fine particles have an average particle diameter of 5 μm or less.

6. The intermediate transfer medium of claim 1, wherein the intermediate transfer medium has a volume resistivity of from $1\times10^{8}$ to $1\times10^{11}$ Ω·cm.

7. The intermediate transfer medium of claim 1, wherein the intermediate transfer medium has a surface resistivity of from 1-$10^{8}$ to $1\times10^{13}$Ω/□.

8. The intermediate transfer medium of claim 1, wherein the spherical fine particles are partially embedded in the elastic layer with an average embedment rate of from 50% to 99%, where the average embedment rate is an average of a rate of embedment of a diameter of each of the spherical fine particles in the elastic layer in a depth direction.

9. The intermediate transfer medium of claim 1, wherein the intermediate transfer medium comprises a seamless belt.

10. An image forming apparatus comprising:

an image bearer configured to bear a latent image and a toner image;

a developing device containing toner, configured to develop the latent image on the image bearer with the toner into the toner image;

the intermediate transfer medium of claim 1, onto which the toner image is primarily transferred; and a transfer device configured to secondarily transfer the toner image on the intermediate transfer medium onto a recording medium.

11. The image forming apparatus of claim 10, wherein the image bearer comprises a plurality of image bearers arranged in series, wherein the developing device comprises a plurality of developing devices containing different color toners, wherein the plurality of developing devices forms a full-color toner image with the different color toners from latent images formed on the plurality of image bearers.

12. The intermediate transfer medium of claim 1, wherein the intermediate transfer belt has a volume resistivity of from $2\times10^{9}$ to $2\times10^{10}$ Ω·cm and a surface resistivity of from $3\times10^{9}$ to $3\times10^{10}$Ω/□.

* * * * *